US007707786B2

(12) United States Patent
Theophilus

(10) Patent No.: US 7,707,786 B2
(45) Date of Patent: May 4, 2010

(54) MODULAR AREA WALL

(76) Inventor: Morgan Theophilus, P.O. Box 893, Urbandale, IA (US) 50322

( * ) Notice: Subject to any disclaimer, the term of this patent is extended or adjusted under 35 U.S.C. 154(b) by 808 days.

(21) Appl. No.: 11/175,687

(22) Filed: Jul. 6, 2005

(65) Prior Publication Data

US 2007/0006537 A1 Jan. 11, 2007

(51) Int. Cl.
*E04B 5/02* (2006.01)
*E04F 17/06* (2006.01)

(52) U.S. Cl. ..... 52/107; 52/584.1; 52/588.1

(58) Field of Classification Search ..... 52/107, 52/169.7, 19, 588.1, 592.1, 245, 248, 249, 52/192, 537, 584.1, 783.14, 848; D25/54; 285/9.2

See application file for complete search history.

(56) References Cited

U.S. PATENT DOCUMENTS

| | | | | | |
|---|---|---|---|---|---|
| 7,412 | A * | 6/1850 | Fisher | 464/183 |
| 989,343 | A * | 4/1911 | Feldt | 285/399 |
| 1,013,440 | A * | 1/1912 | Rankin | 285/406 |
| 1,020,779 | A * | 3/1912 | Putney et al. | 285/406 |
| 1,040,442 | A * | 10/1912 | Shannon | 285/405 |
| 1,077,232 | A * | 10/1913 | Schlafly | 285/405 |
| 1,083,002 | A * | 12/1913 | Charls | 285/411 |
| 1,623,112 | A * | 4/1927 | Hall | 285/55 |
| 1,648,148 | A * | 11/1927 | Quinn | 285/55 |
| 2,453,609 | A * | 11/1948 | Whitehouse | 52/107 |
| 2,571,273 | A * | 10/1951 | McCullough | 52/537 |
| 3,004,634 | A * | 10/1961 | Evans et al. | 52/107 |
| 3,196,733 | A * | 7/1965 | Cohen et al. | 411/51 |
| 3,390,224 | A * | 6/1968 | Wyatt | 174/37 |
| 4,009,520 | A * | 3/1977 | Sukup | 34/233 |
| 4,141,666 | A * | 2/1979 | DeGraff | 405/126 |
| 4,704,828 | A * | 11/1987 | Kemp | 52/107 |
| 4,896,467 | A * | 1/1990 | McGinnis | 52/107 |
| 5,608,998 | A * | 3/1997 | Hume | 52/245 |
| 6,298,631 | B1 | 10/2001 | Finley | |
| 6,848,455 | B1 * | 2/2005 | Shrinivasan et al. | 134/1.3 |
| 7,052,209 | B1 * | 5/2006 | Kruger et al. | 405/125 |
| D566,852 | S * | 4/2008 | Gaster et al. | D25/1 |
| 7,470,085 | B1 * | 12/2008 | Suazo | 405/49 |
| 2004/0098929 | A1 * | 5/2004 | Kim et al. | 52/107 |
| 2005/0238434 | A1 * | 10/2005 | Coppes et al. | 405/49 |
| 2005/0252103 | A1 * | 11/2005 | Cook | 52/107 |
| 2005/0268564 | A1 * | 12/2005 | Theophilus | 52/107 |
| 2009/0090160 | A1 * | 4/2009 | Kemp | 72/379.6 |

OTHER PUBLICATIONS

Monarch Manufacturing, www.monarchmanufacturing.com.

* cited by examiner

*Primary Examiner*—Robert J Canfield
(74) *Attorney, Agent, or Firm*—Brett Trout

(57) ABSTRACT

A modular area wall system for constructing area wall assemblies at a jobsite. The area wall system provides modular sections of varying heights, each provided with a connection plate and a strengthening rib to allow them to be connected to one another in a simple and secure manner. By providing the strengthening rib in overlapping engagement with another area wall section, lighter material of more inexpensive construction may be utilized to reduce the overall cost and weight of the resulting assembly. The system may also be used with sections of varying depth to create a tiered area wall, using teachings of the present invention.

17 Claims, 5 Drawing Sheets

MODULAR AREA WALL

BACKGROUND OF THE INVENTION

1. Field of the Invention

The invention relates in general to a modular area wall system and, more particularly, to an area wall system which is of a lightweight, modular, inexpensive construction, yet is sturdy and adaptable to projects of varying depths below grade.

2. Description of the Prior Art

It is known in the art to provide area walls around windows located below grade. The walls provide for the ingress of light and the egress of persons in the event of a fire. Although poured concrete and masonry area walls are known in the art, the preferred method of protecting below-grade windows from backfill and the like is preformed, galvanized metal area walls having a generally C-shaped cross-section. Given the different depths of windows below grade, area walls of various sizes must be employed. Maintaining a large stock of area walls of various heights is not only expensive, but requires a very large amount of storage space.

To eliminate the need for keeping a large inventory of area walls of various heights in stock, it is known in the art to provide area wall assemblies. Shorter, modular units can be combined to construct area walls of various heights, using the desired plurality of standard sized units. The desired height may be accomplished by coupling the smaller modular units together, either at the factory or on site. One drawback associated with constructing the assemblies at the factory includes the unwieldiness associated with transporting a large area wall assembly to the jobsite. Another drawback is the inability to adjust the area wall on site and/or construct a replacement, should the original become damaged.

One drawback associated with constructing the area wall on sight includes the difficulty in aligning the sections while working below grade. Not only is it difficult to hold the sections in alignment while fastening them together, it is also difficult to avoid coupling the sections together at a cant, with one side having more overlap than the other. An additional drawback associated with constructing area walls on site is trying to align the holes of an attachment fin on one section with the holes of the attachment fin on the other section. Typically, the holes must be in line not only with each other, but also with a securement bar which, in turn, is later secured to the foundation of a building. The difficulty and time associated with making all of the appropriate alignments adds additional cost and delay to the area wall installation.

Another drawback associated with prior art area walls is the cost associated with providing customized corrugations and thicker panels to add strength to the area walls. While it would be desirable to use thinner standard sinusoidal corrugation for the area walls, which would not only be lighter but also cheaper, the difficulty encountered in the prior art heretofore has been that such standard corrugation material has been found to lack the requisite strength to adequately hold back the backfill from the window. It would be, therefore, desirable to provide an area wall of a lightweight, simple construction which also provided the necessary strength for retaining backfill from the window.

Accordingly, it would be desirable to provide a modular area wall system which eliminated the need to maintain a large inventory of area walls of various sizes in stock. It would be desirable to provide a modular area wall system which could be constructed at the jobsite to avoid the unwieldiness associated with transporting a large area wall section, and which provides for quick replacement and/or construction of area walls of a desired height at the jobsite. It would also be desirable to provide a modular area wall system which is of an inexpensive lightweight, sturdy manufacture, and which avoids alignment problems associated with the prior art.

The difficulties encountered in the prior art discussed hereinabove are substantially eliminated by the present invention.

SUMMARY OF THE INVENTION

In an advantage provided by the present invention, a modular area wall section is provided which eliminates the need for maintaining a large plurality of area wall heights in stock.

In an advantage provided by the present invention, a modular area wall system is provided which substantially eliminates tilted securement of modular parts.

In an advantage provided by the present invention, a modular area wall system is provided which eliminates problems associated with aligning holes in attachment fins of modular area wall sections.

In an advantage provided by the present invention, a modular area wall system is provided which eliminates the need for attachment of area wall fins to a securement bar and the subsequent attachment of the securement to the foundation of a building.

In an advantage provided by the present invention, a modular area wall system is provided with a strong and lightweight construction.

In an advantage provided by the present invention, a modular area wall system is provided of a low-cost, easy to manufacture construction. A modular area wall is provided with a first corrugated area wall section and a second corrugated area wall section. The first and second area wall sections are secured to one another in overlapping, mating engagement. A strengthening rib is provided along the top of each area wall section to add additional strength at the connection point between the two area wall sections.

BRIEF DESCRIPTION OF THE DRAWINGS

The present invention will now be described, by way of example, with reference to the accompanying drawings in which.

DETAILED DESCRIPTION OF THE PREFERRED EMBODIMENT

Figure 1:
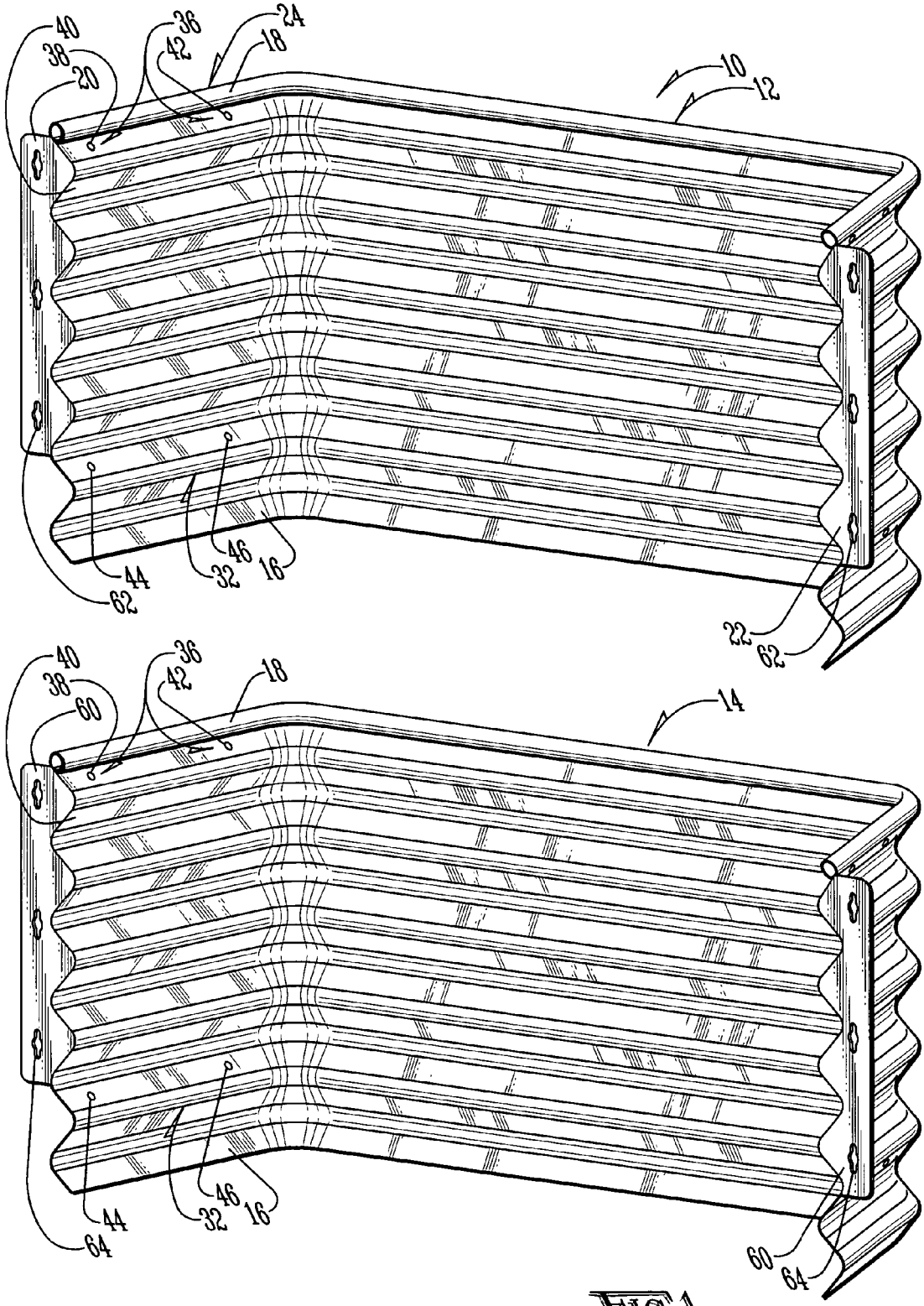
FIG. 1 illustrates a rear perspective view of the area wall system of the present invention, shown with the first area wall section aligned with the second area wall section.

The area wall system of the present invention is shown generally as (10) in FIG. 1. The system (10) includes a first area wall section (12) and a second area wall section (14). Although the area wall sections may be constructed of any material known in the art, in the preferred embodiment, the area wall sections (12) and (14) are constructed of corrugated, galvanized steel having a substantially sinusoidal cross-section in a manner such as that known in the art.

As shown in FIG. 1, the first area wall section (12) and second area wall section (14) are similar in design, each being provided with a lower connection plate (16) and an upper strengthening rib (18). Each area wall section (12) and (14) is also provided with a first attachment fin (20) and second attachment fin (22). The attachment fins (20) and (22) are preferably welded or otherwise secured to the area wall sections (12) and (14). The attachment fins (20) and (22) preferably extend to a point at least one inch, and more preferably five inches, short of the bottom of the area wall sections (12) and (14).

Figure 2:
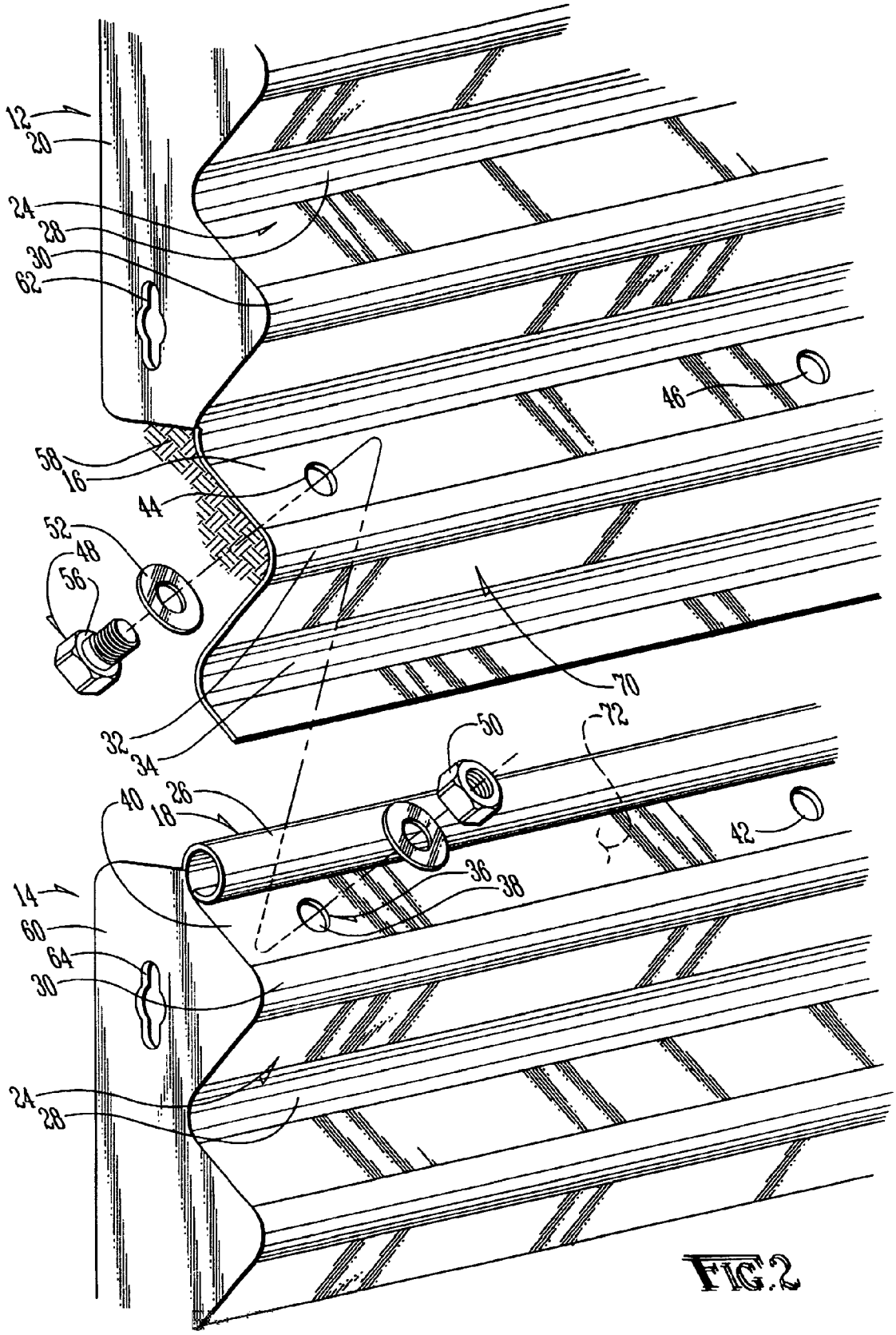
FIG. 2 illustrates a side perspective exploded view of the second area wall section and strengthening rib prior to engagement with the first area wall section.

As shown in FIG. 2, the strengthening rib (18) comprises a portion of the sidewall (24) of the second area wall (14), curled into a tube (26). Although the strengthening rib (18) may be constructed of any desired material, in the referred embodiment, the strengthening rib (18) is constructed of galvanized steel. The sidewall (24) and strengthening rib (18) are constructed of galvanized steel and are integrally formed with one another. The tube (26) is preferably provided with a diameter between 0.1 and 5 inches, more preferably between 0.25 and 2 inches and most preferably approximately one half inch. As shown in FIGS. 1 and 2, the sidewall (24) is provided with a generally sinusoidal cross-section forming valleys (28) and ribs (30) to increase the strength of the area wall (14). As shown in FIG. 2, the connection plate (16) includes a portion of the sidewall (24) extending below the attachment fins (20) and (22), including a rib (32) and a portion of a valley (34).

As shown in FIGS. 1 and 2, the sidewall (24) is provided with a plurality of holes (36). Preferably, the first hole (38) is centered 1 inch from the end (40) of the second area wall section (14). The second hole (42) is preferably provided one foot from the first hole (38). The rib (32) of the connection plate (16) is also provided with a first hole (44) and a second hole (46), oriented in a manner which aligns the first holes (38) and (44), and second holes (42) and (46), when the connection plate (16) is fitted into mating engagement with the second area wall section (14), behind the strengthening rib (18). As shown in FIG. 2, the connection between the first area wall section (12) and the second area wall section (14) includes at least one entire valley (28) or rib (30). Once the first area wall section (12) and second area wall section (14) are positioned with the first holes (38) and (44), and second holes (42) and (46) aligned, a fastener, such as a bolt (48) is provided through a washer (52) and inserted through the first holes (38) and (44). A washer (54) is then provided over the bolt (48), and a nut (50) is thereafter secured to the bolt (48). Preferably, as shown in FIG. 2, the head (56) of the bolt (48) is provided on the side of the area wall sections (12) and (14) in contact with the soil (58).

Figure 3:
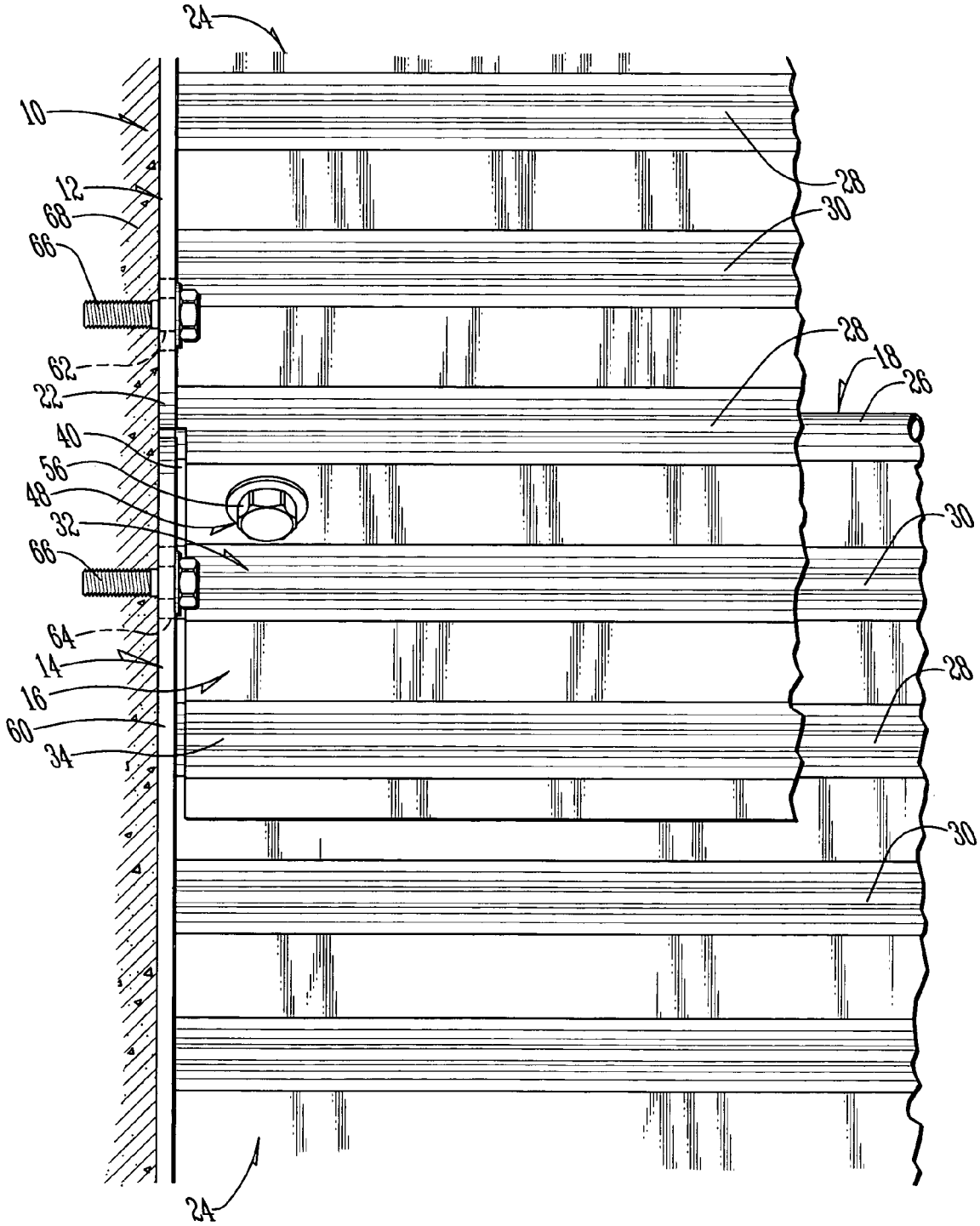
FIG. 3 illustrates a side elevation in cross-section of the attachment fin secured to a building.

As shown in FIGS. 2-3, when the first area wall section (12) and second area wall section (14) are coupled by the bolt (48) and nut (50), the attachment fin (22) of the first area wall section (12) is positioned approximately 0.25 inches from the attachment fin (60) of the second area wall section (14). While the attachment fin (22) of the first area wall section (12) may abut the attachment fin (60) of the second area wall section (14), or be positioned 2 inches or more away, in the preferred embodiment, the attachment fin (22) of the first area wall section (12) does not overlap the attachment fin (60) to the point where either attachment fin (22) or (60) covers holes (62) and (64) respectively associated with attachment fin (22) and attachment fin (60), through which bolts (66) or the like are used to attach the attachment fins (22) and (60) directly to a building (68). (FIGS. 3-4).

Although in the prior art it is known to overlap attachment fins to the point where respective holes align to allow bolts to be secured therethrough, such prior art devices require precise alignment between the fins, which is often difficult to accomplish while actually on a jobsite. Additionally, by eliminating the overlapping and alignment of the attachment fins, there is no need for a prior art mounting bar, to which prior art attachment fins are typically attached, before attaching the mounting bar itself to a building or other structure. As shown in FIGS. 2-3, when it is desired to attach the system (10) to the building (68), the bolts (66) are provided through the holes (62) and (64), and secured to the building (68) by any means known in the art.

Figure 4:
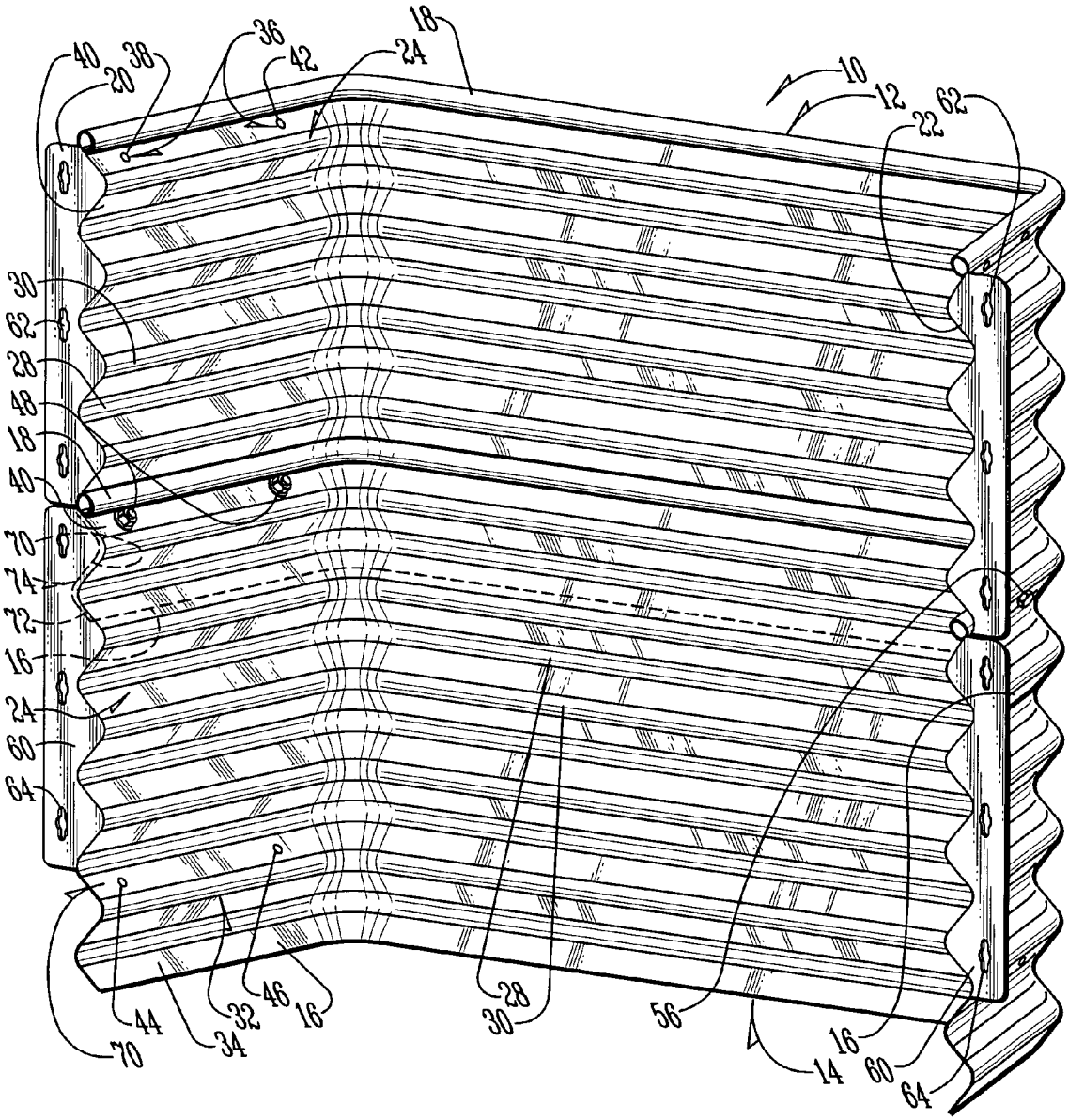
FIG. 4 illustrates a rear perspective view of the present invention shown with the first area wall section secured to the second area wall section.

As shown in FIG. 4, the area wall sections (12) and (14) are secured together utilizing a pair of bolts (48) positioned one foot apart on either side of the area wall sections (12) and (14), and by another pair of bolts (48) securing the faces (70) and (72) of the area wall sections (12) and (14) together in a manner such as that described above, resulting in an area wall assembly (74) of any desired height. As shown in FIG. 3, it is desirable to have the strengthening rib (18) overlap a portion of the first area wall section (12) to provide additional support at this location. Although the strengthening rib (18) may be located at any desired portion of the system (10), it is preferred to have at least one strengthening rib (18) located at the connection point between any area wall sections (12) and (14), and at the top of the area wall assembly (74).

Figure 5:
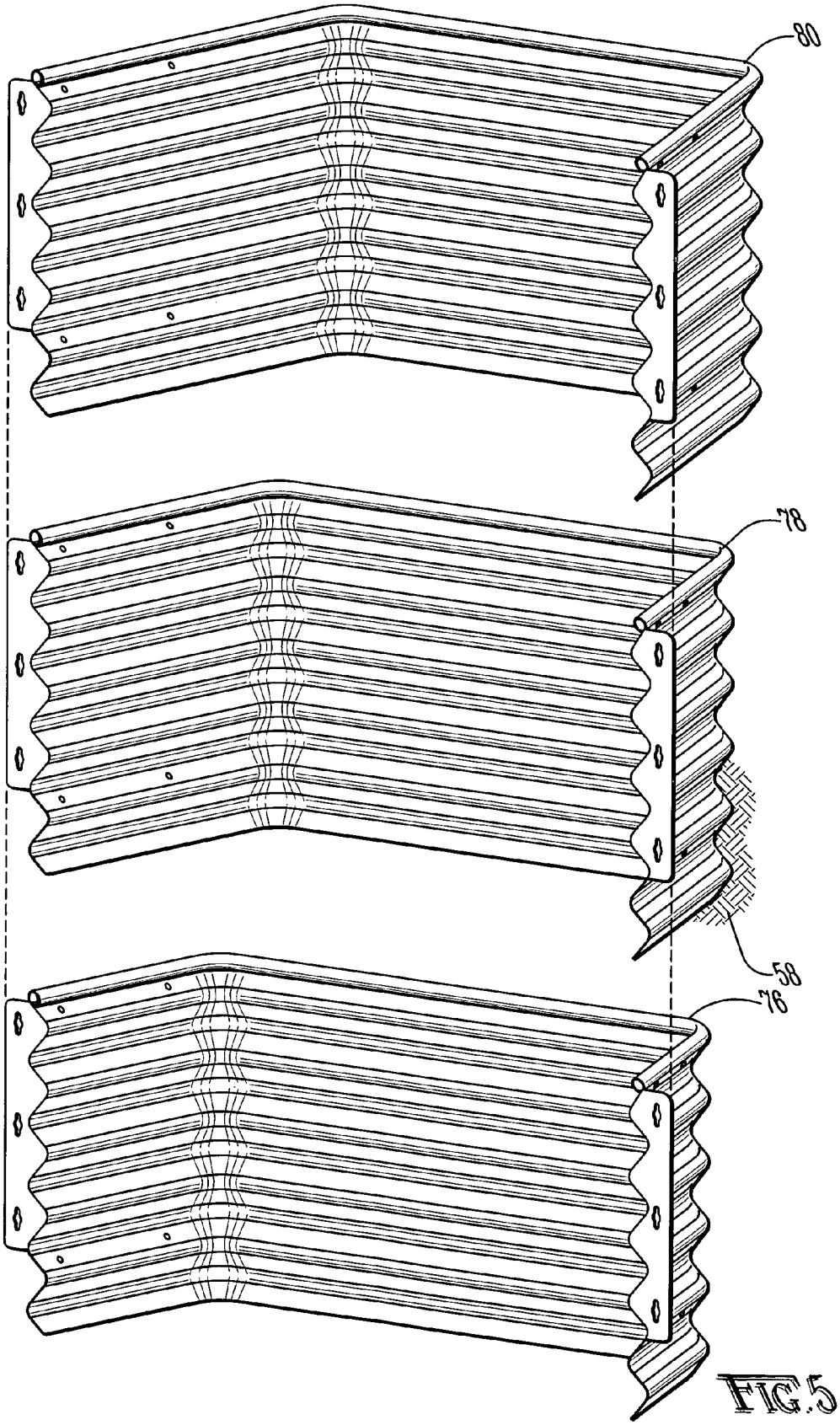
FIG. 5 illustrates a rear perspective view of an alternative embodiment of the present invention shown with area walls of various depths to create a step area wall.

Alternatively, as shown in FIG. 5, area wall sections (76), (78) and (80) may be provided of different depths to create a tiered effect with the soil (58) in a manner such as that known in the prior art, to allow for decorative terracing and/or ease of egress past the area wall sections (76), (78) and (80). The area wall sections (12) and (14) may be provided of any desired height but, in the preferred embodiment are provided at least in heights equal to 24 inches, 30 inches and 36 inches. From these three heights, the area wall sections can be combined in a manner such as that described above to form area wall assemblies (74) of 2 foot, 3 foot, 4 foot, 5 foot, 6 foot, 7 foot and 8 foot heights.

Although the invention has been described with respect to a preferred embodiment thereof, it is to be also understood that it is not to be so limited, since changes or modifications can be made therein which are within the full, intended scope of this invention as defined by the appended claims. For example, it should be noted that the area wall sections (12) and (14) may be constructed of any suitable height, width, configuration or cross-section, and may be constructed of any suitable materials. Additionally, it should be noted that the area wall sections (12) and (14) may not be similar to each other in construction, and may be secured to other area wall sections of the present invention to create any desired resulting assembly of sections.

What is claimed is:

1. A modular area wall comprising:

(a) a first area wall section having a first end and a second end;

(b) a second area wall section having a first end and a second end;

(c) wherein said second area wall section is curved and defines an interior and an exterior;

(d) wherein said second end of said first area wall section is coupled to said first end of said second area wall section;

(e) wherein at least a portion of said first area wall section is exterior said second area wall section;

(f) a substantially hollow tube, positioned closer to said second end of said first area wall section than to said first end of said first area wall section, (g) wherein said substantially hollow tube is positioned closer to said first end of said second area wall section than said second end of said second area wall section and (h) a fastener provided through said first area wall section and said second area wall section.

2. The modular area wall of claim 1, wherein said substantially hollow tube is coupled to said first end of said second area wall section.

3. The modular area wall of claim 2, wherein said substantially hollow tube comprises an arcuate plate.

4. The modular area wall of claim 1, wherein said first area wall comprises:

(a) a corrugated, arcuately curved first faceplate;

(b) a first attachment fin coupled to said first faceplate;

(c) a second attachment fin coupled to said first faceplate; and wherein said second area wall comprises:

(a) a corrugated, arcuately curved second faceplate;

(b) a third attachment fin coupled to said second faceplate;

(c) a fourth attachment fin coupled to said second faceplate.

5. The modular area wall of claim 4, wherein a first portion of said first faceplate extends beyond said first attachment fin at least one inch.

6. The modular area wall of claim 4, wherein said second end of said first area wall section is coupled to said first end of said second area wall section in a mating engagement in which said second faceplate overlaps said first faceplate and in which said first attachment fin is substantially aligned with, but which does not overlap, said third attachment fin.

7. The modular area wall of claim 6, wherein said fastener is secured through said first faceplate and said second faceplate.

8. The modular area wall of claim 6, wherein said substantially hollow tube is coupled to said first end of said second faceplate.

9. The modular area wall of claim 8, further comprising a supplemental substantially hollow tube coupled to said first end of said first faceplate.

10. The modular area wall of claim 8, wherein said substantially hollow tube comprises a curved arcuate plate integrally formed with said first end of said second faceplate.

11. The modular area wall of claim 10, wherein said substantially hollow tube is provided with a substantially circular cross-section.

12. A modular area wall comprising:

(a) a first area wall comprising:

(1) a first curved faceplate comprising:

(i) a first face;

(ii) a second face;

(iii) a first end;

(iv) a second end;

(v) a third end;

(vi) a fourth end;

(2) wherein said first curved faceplate defines a first plurality of corrugations;

(3) a first substantially hollow tube coupled to said first end of said first curved faceplate;

(4) a first lip coupled to said second end of said first curved faceplate;

(5) a first attachment fin coupled to said third end of said first curved faceplate;

(6) a second attachment fin coupled to said fourth end of said first curved faceplate;

(b) a second area wall section comprising:

(1) a second curved faceplate comprising:

(i) a first face;

(ii) a second face;

(iii) a first end;

(iv) a second end;

(v) a third end;

(vi) a fourth end;

(2) wherein said second curved faceplate defines a second plurality of corrugations;

(3) a second substantially hollow tube coupled to said first end of said second curved faceplate;

(4) a second lip coupled to said second end of said second curved faceplate;

(5) a third attachment fin coupled to said third end of said second curved faceplate;

(6) a fourth attachment fin coupled to said fourth end of said second curved faceplate;

(c) a fastener securing a portion of said first plurality of corrugations in mating relationship with said second plurality of corrugations;

(d) wherein said first area wall is located exterior said second substantially hollow tube;

(e) wherein said second area wall is curved and defines an interior and an exterior; and (f) wherein said first area wall is secured completely exterior of said interior defined by said second area wall.

13. The modular area wall of claim 12, wherein said first attachment fin and said third attachment fin define an interstice therebetween, wherein said interstice is at least one tenth of an inch between said first attachment fin and said third attachment fin, and wherein said interstice is no greater than twenty inches between said first attachment fin and said third attachment fin.

14. The modular area wall of claim 12, wherein said second substantially hollow tube is provided with a substantially circular cross-section.

15. The modular area wall of claim 12, wherein said second substantially hollow tube is formed integral with said second curved faceplate and wherein said second substantially hollow tube overlaps at least a portion of said first curved faceplate.

16. The modular area wall of claim 12, further comprising:

(a) a third area wall section comprising:

(1) a third curved faceplate comprising:

(i) a first face;

(ii) a second face;

(iii) a first end;

(iv) a second end;

(v) a third end;

(vi) a fourth end;

(2) wherein said third curved faceplate defines a third plurality of corrugations;

(3) a third substantially hollow tube coupled to said first end of said third curved faceplate;

(4) a third lip coupled to said second end of said third curved faceplate;

(5) a first attachment fin coupled to said third end of said third curved faceplate;

(6) a second attachment fin coupled to said fourth end of said third curved faceplate; and (b) a fastener securing a portion of said second plurality of corrugations in mating relationship with said third plurality of corrugations.

17. The modular area wall of claim 16, wherein said third substantially hollow tube is formed integral with said third curved faceplate and wherein said third substantially hollow tube overlaps at least a portion of said second curved faceplate.

* * * * *